US010946676B2

(12) United States Patent
Yoshida

(10) Patent No.: US 10,946,676 B2
(45) Date of Patent: Mar. 16, 2021

(54) BASE MATERIAL PROCESSING APPARATUS AND DETECTION METHOD

(71) Applicant: SCREEN HOLDINGS CO., LTD., Kyoto (JP)

(72) Inventor: Mitsuhiro Yoshida, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 0 days.

(21) Appl. No.: 16/552,543

(22) Filed: Aug. 27, 2019

(65) Prior Publication Data

US 2020/0094589 A1 Mar. 26, 2020

(30) Foreign Application Priority Data

Sep. 20, 2018 (JP) ..... JP2018-176424

(51) Int. Cl.
*B41J 13/00* (2006.01)

(52) U.S. Cl.
CPC ..... *B41J 13/0009* (2013.01)

(58) Field of Classification Search
None
See application file for complete search history.

(56) References Cited

U.S. PATENT DOCUMENTS

2003/0116042 A1 6/2003 Ohba et al.
2008/0122889 A1 5/2008 Naoi et al.
2015/0009256 A1* 1/2015 Bildstein ..... B65H 23/032 347/16
2016/0075155 A1 3/2016 Fukui et al.

FOREIGN PATENT DOCUMENTS

EP 3 275 676 A1 1/2018
JP 2016-055570 A 4/2016

OTHER PUBLICATIONS

Extended European Search Report issued in corresponding European Patent Application No. 19193667.3-1017, dated Feb. 6, 2020.

* cited by examiner

*Primary Examiner* — Alejandro Valencia
(74) *Attorney, Agent, or Firm* — McDermott Will & Emery LLP

(57) ABSTRACT

A displacement amount calculation part in a base material processing apparatus calculates the degree of matching between an upstream data section and a downstream data section included in an upstream and a downstream detection results, which indicate time-varying changes in the positions of an edge of the base material in the width direction at an upstream and a downstream detection positions. This calculation uses the results of comparison between signals in a predetermined frequency band extracted from the upstream detection result and signals in the predetermined frequency band extracted from the downstream detection result. Accordingly, a downstream data section that is highly matched with the upstream data section can be identified with high accuracy, and the amount of displacement of the base material in the transport direction can be detected with high accuracy on the basis of an identification result.

16 Claims, 12 Drawing Sheets

BASE MATERIAL PROCESSING APPARATUS AND DETECTION METHOD

RELATED APPLICATIONS

This application claims the benefit of Japanese Application No. 2018-176424, filed on Sep. 20, 2018, the disclosure of which is incorporated by reference herein.

BACKGROUND OF THE INVENTION

Field of the Invention

The present invention relates to a technique for use in a base material processing apparatus that processes a long band-like base material while transporting the base material, and for detecting the amount of displacement of the base material in the transport direction or the amount of difference in the transport speed of the base material.

Description of the Background Art

There have conventionally been known inkjet image recording apparatuses that record a multicolor image on long band-like printing paper by ejecting ink from a plurality of recording heads while transporting the printing paper in a longitudinal direction of the paper. The image recording apparatuses eject ink of different colors from the heads. Then, single-color images formed by each color ink are superimposed on one another so that a multicolor image is recorded on a surface of the printing paper. One example of the conventional image recording apparatuses is described in, for example, Japanese Patent Application Laid-Open No. 2016-55570.

This type of image recording apparatuses are designed to transport printing paper at a constant speed with a plurality of rollers. However, the transport speed of the printing paper under the recording heads may differ from an ideal transport speed due to skids occurring between the surface of each roller and the printing paper or due to elongation of the printing paper caused by the ink. This causes the ejection position of each color ink to be displaced in the transport direction on the surface of the printing paper, thereby causing mutual misregistration of the single-color images.

In order to suppress such mutual misregistration of the single-color images, reference images such as register marks have conventionally been formed on the surface of the printing paper. The image recording apparatuses detect the positions of the reference images and correct the ejection position of ink from each recording head on the basis of detection results. The reference images are, however, formed at predetermined intervals in the transport direction of the printing paper. Thus, it is difficult to successively detect displacement of the printing paper on the basis of the reference images. Besides, the reference images formed on the surface of the printing paper narrows the space for recording an intended print image.

SUMMARY OF THE INVENTION

It is an object of the present invention to provide a technique for use in a base material processing apparatus that processes a long band-like base material while transporting the base material in a longitudinal direction, and for detecting the amount of displacement of the base material in the transport direction or the amount of difference in the transport speed of the base material with high accuracy without depending on images such as register marks formed on the surface of the base material.

To solve the problems described above, a first aspect of the present invention is a base material processing apparatus that includes a transport mechanism that transports a long band-like base material in a longitudinal direction along a predetermined transport path, an upstream detector that successively or intermittently detects a position of an edge of the base material in a width direction at an upstream detection position in the transport path to acquire an upstream detection result, a downstream detector that successively or intermittently detects the position of the edge of the base material in the width direction at a downstream detection position located downstream of the upstream detection position in the transport path to acquire a downstream detection result, and a displacement amount calculation part that, for each upstream data section that is a data section included in the upstream detection result, identifies a highly matched downstream data section from among a plurality of downstream data sections that are data sections included in the downstream detection result, and calculates an amount of displacement of the base material in a transport direction or an amount of difference in a transport speed of the base material on the basis of an identification result. The displacement amount calculation part uses a result of comparison between signals in a predetermined frequency band extracted from the upstream detection result and signals in the predetermined frequency band extracted from the downstream detection result to identify the highly matched downstream data section for each of the upstream data sections.

A second aspect of the present invention is a detection method of detecting an amount of displacement of a long band-like base material in a transport direction or an amount of difference in a transport speed of the base material while transporting the base material in a longitudinal direction along a predetermined transport path. The detection method includes a) successively or intermittently detecting a position of an edge of the base material in a width direction at an upstream detection position in the transport path to acquire an upstream detection result, b) successively or intermittently detecting the position of the edge of the base material in the width direction at a downstream detection position located downstream of the upstream detection position in the transport path to acquire a downstream detection result, and c) for each upstream data section that is a data section included in the upstream detection result, identifying a highly matched downstream data section from among a plurality of downstream data sections that are data sections included in the downstream detection result, and calculating the amount of displacement of the base material in the transport direction or the amount of difference in the transport speed of the base material on the basis of an identification result. In the operation c), a result of comparison between signals in a predetermined frequency band extracted from the upstream detection result and signals in the predetermined frequency band extracted from the downstream detection result is used to identify the highly matched downstream data section for each of the upstream data sections.

According to the first and the second aspects of the present invention, a downstream data section that is highly matched with the upstream data section can be identified with high accuracy. This enables highly accurate detection of the amount of displacement of the base material in the transport direction or the amount of difference in the transport speed of the base material. Also, the amount of computation performed by the displacement amount calculation part can be reduced, which contributes a cost reduction.

These and other objects, features, aspects and advantages of the present invention will become more apparent from the following detailed description of the present invention when taken in conjunction with the accompanying drawings.

DESCRIPTION OF PREFERRED EMBODIMENTS

Embodiments of the present invention will be described hereinafter with reference to the drawings.

1. First Embodiment

1-1. Configuration of Image Recording Apparatus

Figure 1:
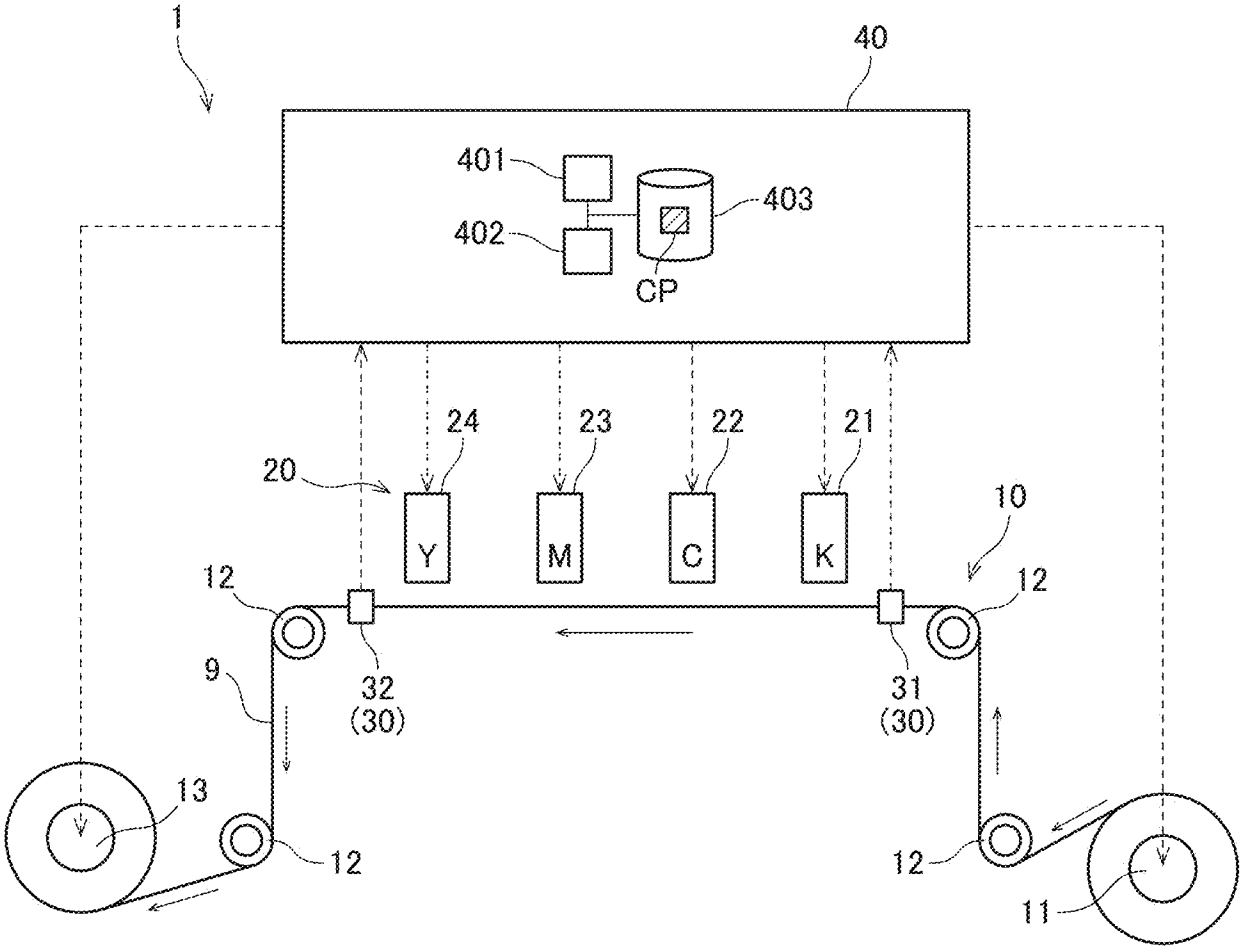
FIG. 1 illustrates a configuration of an image recording apparatus according to a first embodiment.

FIG. 1 illustrates a configuration of an image recording apparatus 1 as one example of a base material processing apparatus according to a first embodiment of the present invention. The image recording apparatus 1 is an inkjet printing apparatus that records a multicolor image on printing paper 9, which is a long band-like base material, by ejecting ink from a plurality of recording heads 21 to 24 toward the printing paper 9 while transporting the printing paper 9. As illustrated in FIG. 1, the image recording apparatus 1 includes a transport mechanism 10, an image recording part 20, two edge sensors 30, and a controller 40.

The transport mechanism 10 is a mechanism for transporting the printing paper 9 in a transport direction that is along the longitudinal direction of the printing paper 9. The transport mechanism 10 according to the present embodiment includes a plurality of rollers including a feed roller 11, a plurality of transport rollers 12, and a take-up roller 13. The printing paper 9 is fed from the feed roller 11 and transported at a speed of, for example, 1 msec along a predetermined transport path configured by the plurality of transport rollers 12. Each transport roller 12 rotates about a horizontal axis so as to guide the printing paper 9 downstream of the transport path. The transported printing paper 9 is collected by the take-up roller 13. These rollers are rotationally driven by a drive part 45 of the controller 40, which will be described later.

As illustrated in FIG. 1, the printing paper 9 travels in approximately parallel with the direction of arrangement of the plurality of recording heads 21 to 24 under the recording heads 21 to 24. At this time, the record surface (front surface) of the printing paper 9 faces upward (i.e., faces the recording heads 21 to 24). The printing paper 9 runs under tension over the plurality of transport rollers 12. This configuration suppresses the occurrence of slack or creases in the printing paper 9 during transport.

The image recording part 20 is a processing part that ejects ink droplets to the printing paper 9 that is being transported by the transport mechanism 10. The image recording part 20 according to the present embodiment includes the first recording head 21, the second recording head 22, the third recording head 23, and the fourth recording head 24. The first, second, third, and fourth recording heads 21, 22, 23, and 24 are arranged in the transport direction of the printing paper 9.

Figure 2:
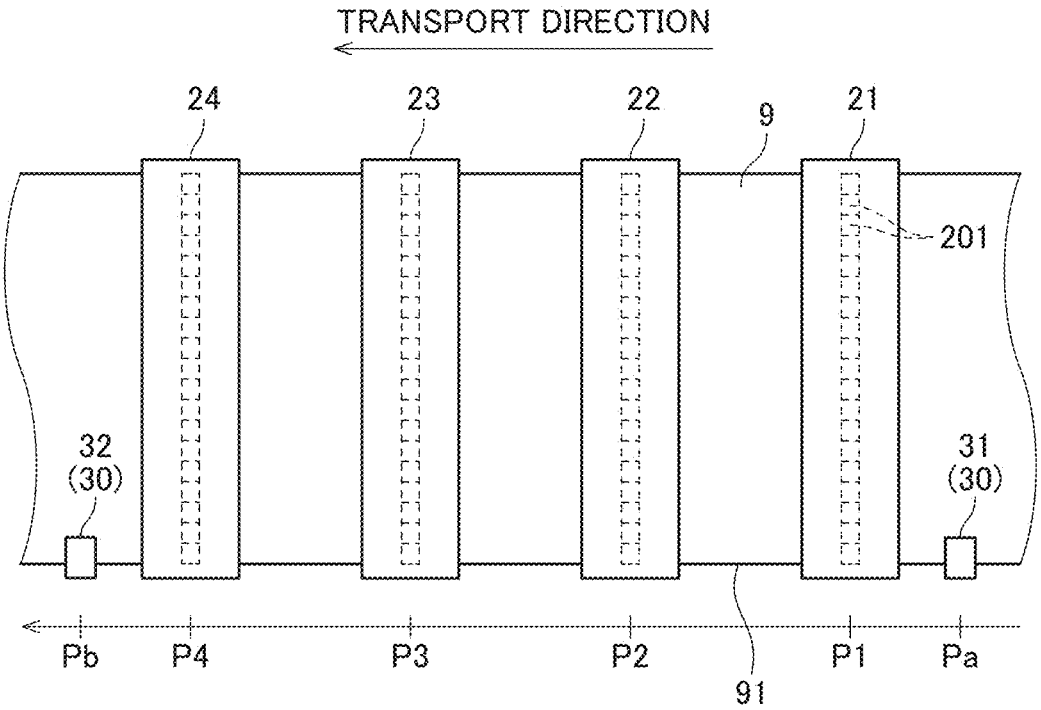
FIG. 2 is a partial top view of the image recording apparatus in the proximity of an image recording part according to the first embodiment.

FIG. 2 is a partial top view of the image recording apparatus 1 in the proximity of the image recording part 20. The four recording heads 21 to 24 each cover the overall dimension of the printing paper 9 in the width direction (i.e., the horizontal direction which is also orthogonal to the transport direction). As indicated by broken lines in FIG. 2, each of the recording heads 21 to 24 has a lower surface provided with a plurality of nozzles 201 aligned in parallel with the width direction of the printing paper 9. The recording heads 21 to 24 respectively eject black (K), cyan (C), magenta (M), and yellow (Y) ink droplets, which are color components of a multicolor image, from their nozzles 201 toward the upper surface of the printing paper 9.

That is, the first recording head 21 ejects black ink droplets to the upper surface of the printing paper 9 at a first processing position P1 in the transport path. The second recording head 22 ejects cyan ink droplets to the upper surface of the printing paper 9 at a second processing position P2 that is located downstream of the first processing position P1. The third recording head 23 ejects magenta ink droplets to the upper surface of the printing paper 9 at a third processing position P3 that is located downstream of the second processing position P2. The fourth recording head 24 ejects yellow ink droplets to the upper surface of the printing paper 9 at a fourth processing position P4 that is located downstream of the third processing position P3. In the present embodiment, the first, second, third, and fourth processing positions P1, P2, P3, and P4 are aligned at equal intervals in the transport direction of the printing paper 9.

The four recording heads 21 to 24 each eject ink droplets so as to record a single-color image on the upper surface of the printing paper 9. Then, the four single-color images are superimposed on one another so that a multicolor image is formed on the upper surface of the printing paper 9. If the positions of ejection of ink droplets from the four recording heads 21 to 24 are displaced from one another in the transport direction on the printing paper 9, the image quality of printed matter will deteriorate. Thus, controlling such mutual misregistration of the single-color images on the printing paper 9 to fall within tolerance is an important factor for improving the print quality of the image recording apparatus 1.

Note that a dry processing part for drying the ink ejected to the record surface of the printing paper 9 may additionally be provided downstream of the recording heads 21 to 24 in the transport direction. The dry processing part is, for example, configured to dry ink by blowing heated gas toward the printing paper 9 and vaporizing a solvent in the ink that adheres to the printing paper 9. The dry processing part may, however, dry ink by other methods, such as with heating rollers or by photoirradiation.

The two edge sensors 30 serve as detectors that detect the position of an edge 91 (end in the width direction) of the printing paper 9 in the width direction. In the present embodiment, the edge sensors 30 are disposed at an upstream detection position Pa located upstream of the first processing position P1 in the transport path and at a downstream detection position Pb located downstream of the fourth processing position P4.

Figure 3:
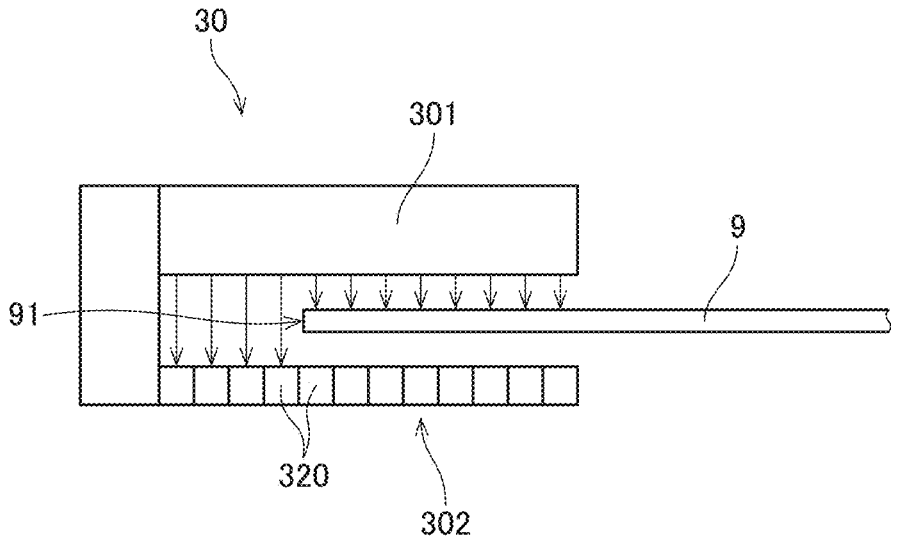
FIG. 3 schematically illustrates a structure of an edge sensor according to the first embodiment.

FIG. 3 schematically illustrates a structure of each edge sensor 30. As illustrated in FIG. 3, the two edge sensors 30 each include a projector 301 that is located above the edge 91 of the printing paper 9, and a line sensor 302 that is located below the edge 91. The projector 301 emits parallel light downward. The line sensor 302 includes a plurality of light receiving elements 320 aligned in the width direction. As illustrated in FIG. 3, outside of the edge 91 of the printing paper 9, the light emitted from the projector 301 enters the light receiving elements 320, and the light receiving elements 320 detect that light. On the other hand, inside of the edge 91 of the printing paper 9, the light emitted from the projector 301 is blocked by the printing paper 9, and therefore the light receiving elements 320 do not detect that light. The edge sensors 30 detect the position of the edge 91 of the printing paper 9 in the width direction on the basis of whether the light has been detected by the light receiving elements 320.

As illustrated in FIGS. 1 and 2, the edge sensor 30 disposed at the upstream detection position Pa is hereinafter referred to as an "upstream edge sensor 31." Also, the edge sensor 30 disposed at the downstream detection position Pb is referred to as a "downstream edge sensor 32." The upstream edge sensor 31 is one example of an "upstream detector" according to the present invention. The upstream edge sensor 31 intermittently detects the position of the edge 91 of the printing paper 9 in the width direction at the upstream detection position Pa. Thereby, the upstream edge sensor 31 acquires a detection result (hereinafter, referred to as an "upstream detection result R1") that indicates a time-varying change in the position of the edge 91 in the width direction at the upstream detection position Pa. The upstream edge sensor 31 then outputs a detection signal indicating the acquired upstream detection result R1 to the controller 40. The downstream edge sensor 32 is one example of a "downstream detector" according to the present invention. The downstream edge sensor 32 intermittently detects the position of the edge 91 of the printing paper 9 in the width direction at the downstream detection position Pb. Thereby, the downstream edge sensor 32 acquires a detection result (hereinafter, referred to as a "downstream detection result R2") that indicates a time-varying change in the position of the edge 91 in the width direction at the downstream detection position Pb. The downstream edge sensor 32 then outputs a detection signal indicating the acquired downstream detection result R2 to the controller 40.

The controller 40 controls operations of each part of the image recording apparatus 1. As schematically illustrated in FIG. 1, the controller 40 is configured by a computer that includes a processor 401 such as a CPU, a memory 402 such as a RAM, and a storage device 403 such as a hard disk drive. The storage device 403 stores a computer program CP for executing print processing. As indicated by broken lines in FIG. 1, the controller 40 is electrically connected to each of the transport mechanism 10, the four recording heads 21 to 24, and the two edge sensors 30, which have been described above. The controller 40 controls operations of these parts in accordance with the computer program CP. In this way, print processing proceeds in the image recording apparatus 1.

1-2. Detection and Correction Processing

In the case of executing print processing, the controller 40 acquires the detection signal indicating the upstream detection result R1 from the upstream edge sensor 31 and acquires the detection signal indicating the downstream detection result R2 from the downstream edge sensor 32. The controller 40 then detects the amount of displacement of the printing paper 9 in the transport direction on the basis of the acquired detection signals. The controller 40 also corrects the timing of ejection of ink droplets from the four recording heads 21 to 24 on the basis of the detected amount of displacement. This suppresses the aforementioned mutual misregistration of the single-color images.

Figure 4:
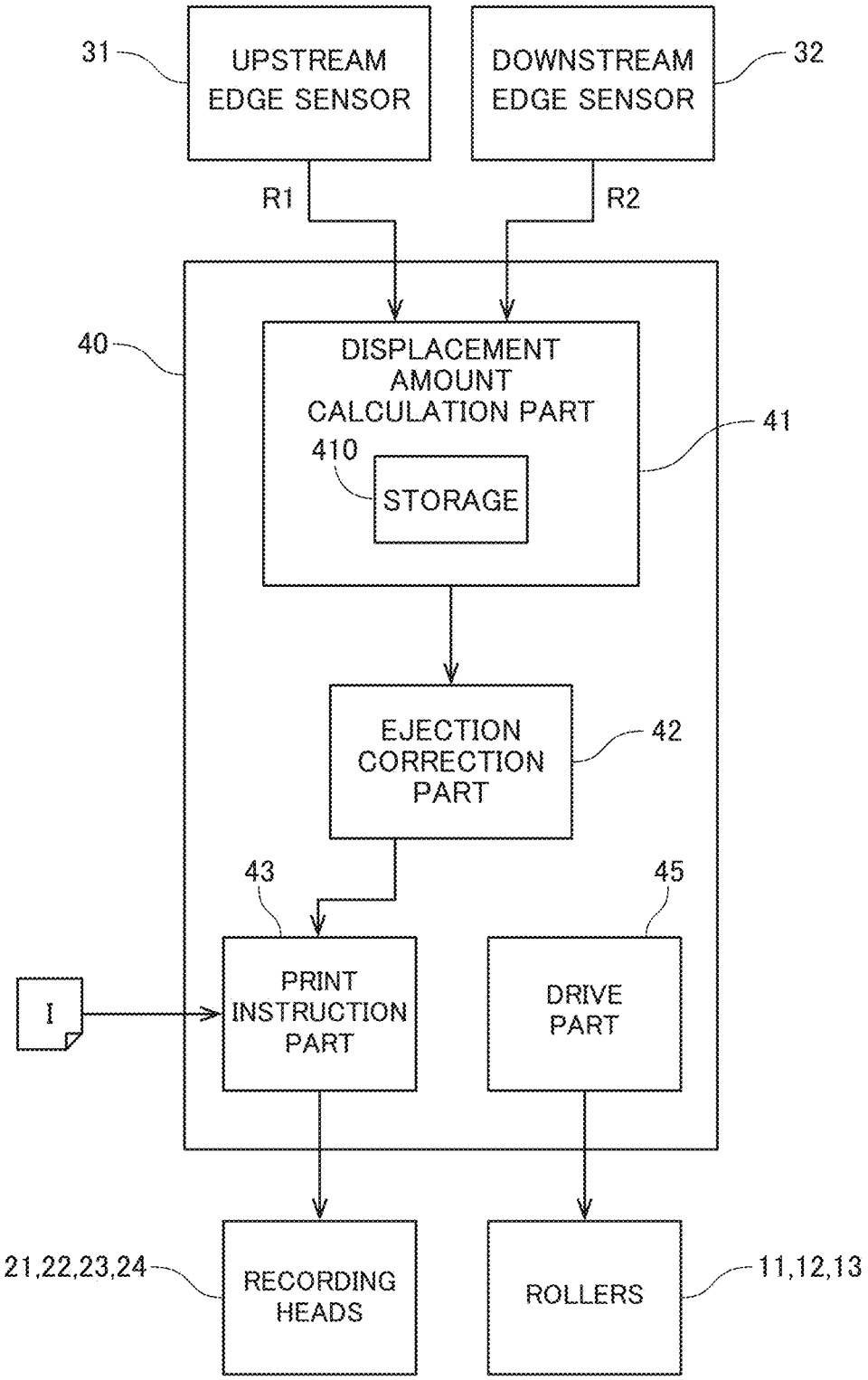
FIG. 4 is a block diagram schematically illustrating functions of a controller according to the first embodiment.

FIG. 4 is a block diagram schematically illustrating functions of the controller 40 for implementing the detection and correction processing. As illustrated in FIG. 4, the controller 40 includes a displacement amount calculation part 41, an ejection correction part 42, a print instruction part 43, and the drive part 45. The functions of the displacement amount calculation part 41, the ejection correction part 42, the print instruction part 43, and the drive part 45 are implemented by the processor 401 operating in accordance with the computer program CP. Note that the displacement amount calculation part 41, the ejection correction part 42, the print instruction part 43, and the drive part 45 may be implemented by dedicated circuits such as FPGAs. The drive part 45 rotationally drives at least one of the plurality of rollers including the feed roller 11, the plurality of transport rollers 12, and the take-up roller 13 at a constant rotation speed, so that the printing paper 9 is transported along the transport path.

The displacement amount calculation part 41 calculates the amount of displacement of the printing paper 9 in the transport direction on the basis of the upstream detection result R1 obtained from the upstream edge sensor 31 and the downstream detection result R2 obtained from the downstream edge sensor 32. Note that the displacement amount calculation part 41 includes a storage 410 that temporarily stores the detection signal acquired from the upstream edge sensor 31 and indicating the upstream detection result R1 and the detection signal acquired from the downstream edge sensor 32 and indicating the downstream detection result R2. The function of the storage 410 is implemented by, for example, the memory 402 or the storage device 403 described above. The displacement amount calculation part 41 executes each processing while reading out signals included in the upstream detection result R1 and signals included in the downstream detection result R2 from the storage 410.

Figure 5A:
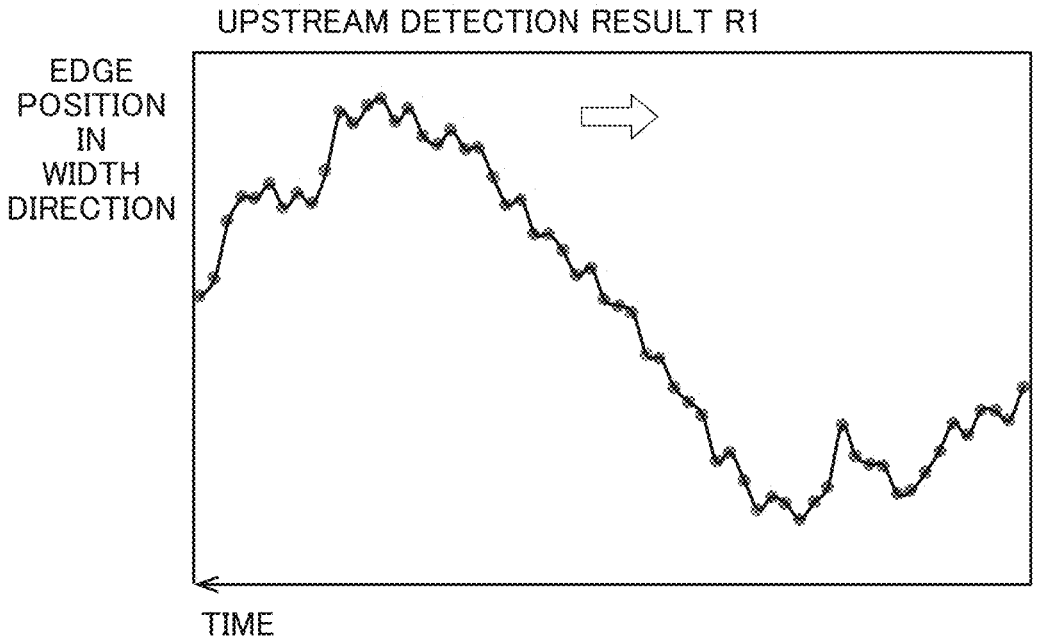
FIG. 5A is a graph showing an example of an upstream detection result according to the first embodiment.
Figure 5B:
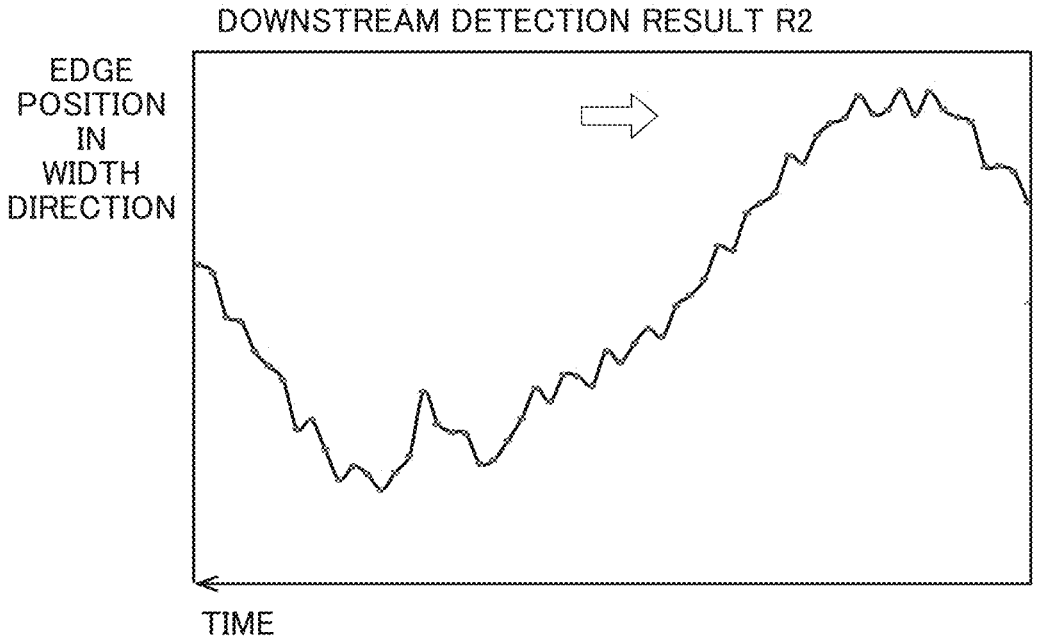
FIG. 5B is a graph showing an example of a downstream detection result according to the first embodiment.

FIG. 5A is a graph showing an example of the upstream detection result R1. FIG. 5B is a graph showing an example of the downstream detection result R2. In the graphs in FIGS. 5A and 5B, the horizontal axis represents time, and the vertical axis represents the position of the edge 91 in the width direction. Note that the left end of the horizontal axis of the graphs in FIGS. 5A and 5B represents current time, and the time gets earlier as the distance to the right from the left end increases. Thus, the data lines in FIGS. 5A and 5B move to the right with the passage of time, as indicated by hollow arrows. Accordingly, for example, a value at the right end of the data line in FIG. 5A indicates the position of the edge 91 in the width direction of a portion of the printing paper 9 that has passed through the upstream edge sensor 31 at the earliest time in the data line in FIG. 5A. Also, the value at the right end of the data line in FIG. 5B indicates the position of the edge 91 in the width direction of a portion of the printing paper 9 that has passed through the downstream edge sensor 32 at the earliest time in the data line in FIG. 5B.

The upstream edge sensor 31 and the downstream edge sensor 32 detect the position of the edge 91 of the printing paper 9 in the width direction at pre-set considerably short time intervals (e.g., every 50 μsec). Thereby, the edge sensors acquire data that indicates a time-varying change in the position of the edge 91 of the printing paper 9 in the width direction as illustrated in FIGS. 5A and 5B. The upstream detection result R1 illustrated in FIG. 5A is data that reflects the shape of the edge 91 of the printing paper 9 passing through the upstream detection position Pa. The downstream detection result R2 illustrated in FIG. 5B is data that reflects the shape of the edge 91 of the printing paper 9 passing through the downstream detection position Pb.

Figure 6A:
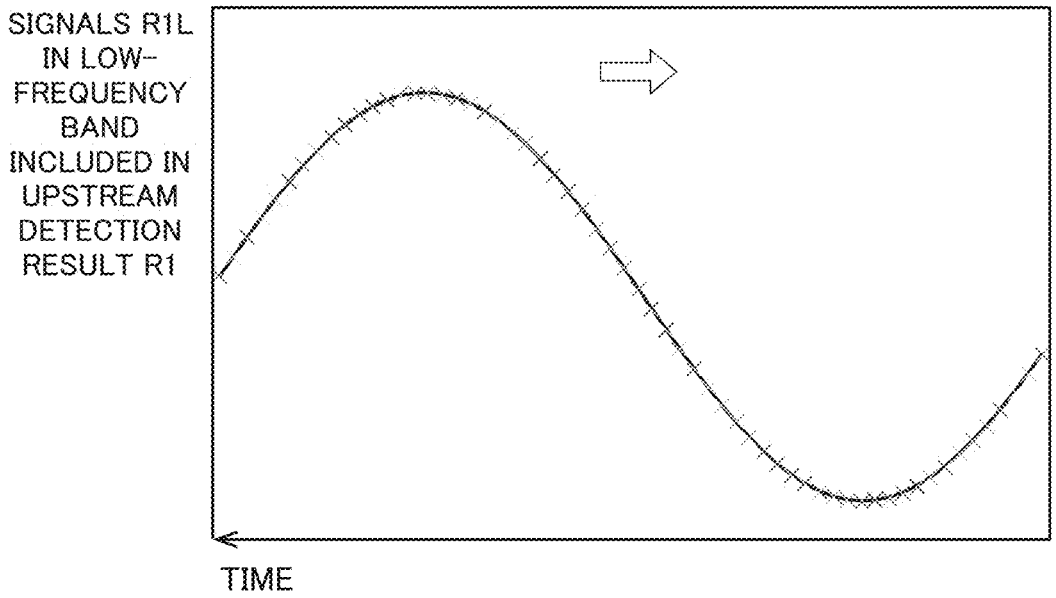
FIG. 6A is a graph showing an example of signals in a low frequency band included in the upstream detection result according to the first embodiment.
Figure 6B:
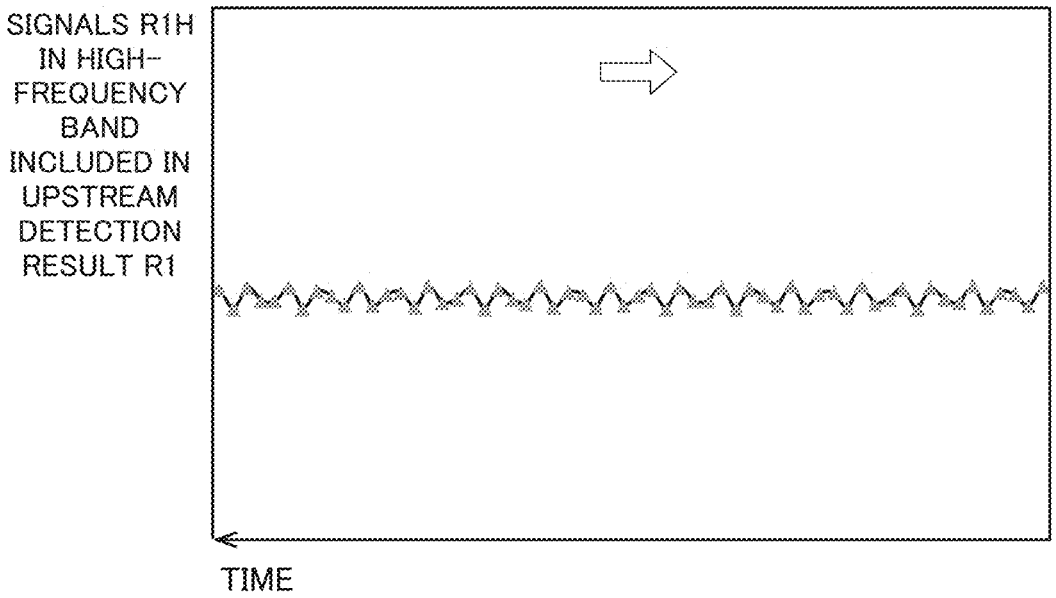
FIG. 6B is a graph showing an example of signals in a high frequency band included in the upstream detection result according to the first embodiment.

The upstream detection result R1 illustrated in FIG. 5A and the downstream detection result R2 illustrated in FIG. 5B each include noise. FIGS. 6A and 6B are graphs showing examples of the noise included in the upstream detection result R1. In particular, FIG. 6A shows an example of signals R1L in a low frequency band included in the upstream detection result R1. The signals R1L in the low frequency band correspond to, for example, meandering motion of the printing paper 9 during transport and have wavelengths of 2000 μm or higher. FIG. 6B shows an example of signal R1H in a high frequency band included in the upstream detection result R1. The signals R1H in the high frequency band correspond to, for example, vibrations applied to the printing paper 9 by the transport mechanism 10 or fluctuations in the electrical characteristics of the upstream edge sensor 31, and have wavelengths less than 100 μm. Using a bandpass filter, the displacement amount calculation part 41 performs filtering processing on the upstream detection result R1 to exclude the signals R1L in the low frequency band and the signals R1H in the high frequency band. Thereby, the displacement amount calculation part 41 extracts signals R1M in a predetermined frequency band illustrated in FIG. 6C from the upstream detection result R1.

Similarly, using a bandpass filter, the displacement amount calculation part 41 performs filtering processing on the downstream detection result R2 to remove signals in the low frequency band and signals in the high frequency band. Thereby, the displacement amount calculation part 41 extracts signals R2M in the predetermined frequency band illustrated in FIG. 7 from the downstream detection result R2. It is preferable that the range of filtering using a bandpass filter is set in advance in consideration of, for example, the transport speed of the printing paper 9.

The edge 91 of the printing paper 9 has fine irregularities. The irregularities include those originating from the shape of a composition of the printing paper 9. For example, in the case where the printing paper 9 is paper composed of thin and soft fibers such as cellulose fibers, irregularities are formed depending on the orientations of the cellulose fibers at the edge 91 (end in the width direction) of the printing paper 9. That is, irregularities are formed originating from the length or width (e.g., 20 μm) of the cellulose fibers. In the case where the base material is composed of, for example, a hard film or metal leaf, instead of the printing paper 9, irregularities originating from the shape of a blade of a cutting tool for cutting the edge 91 are formed at the edge 91 (end in the width direction). The shape of the edge 91 originating from the shape of the composition of the printing paper 9 and the shape of the edge 91 originating from the shape of the blade of a cutting tool are specific to each portion of the edge 91, unlike the aforementioned signals R1L in the low frequency band and the aforementioned signals R1H in the high frequency band.

In the present embodiment, the signals R1M in the predetermined frequency band extracted from the upstream detection result R1 and the signals R2M in the predetermined frequency band extracted from the downstream detection result R2 each mainly include signals in a frequency band that corresponds to the shape of at least part of the composition of the printing paper 9 (e.g., signals in a frequency band that corresponds to the length or width of cellulose fibers that are the composition of paper, i.e., the printing paper 9) or signals in a frequency band that corresponds to the shape of the edge 91 of, for example, the printing paper 9 that has undergone cutting processing.

Figure 6C:
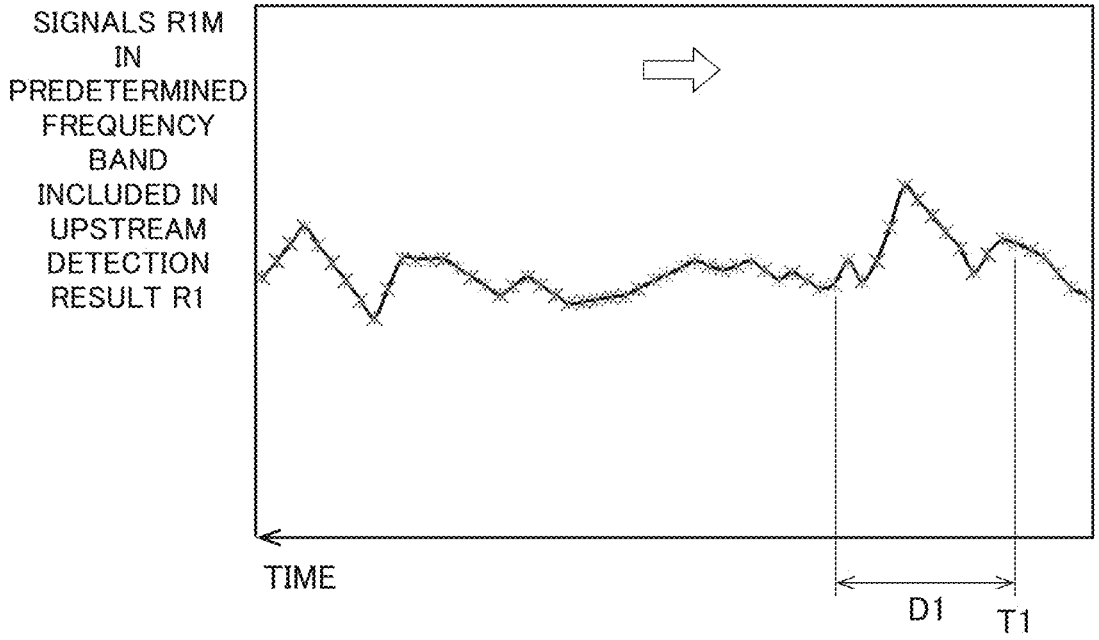
FIG. 6C is a graph showing an example of signals in a predetermined frequency band included in the upstream detection result according to the first embodiment.
Figure 7:
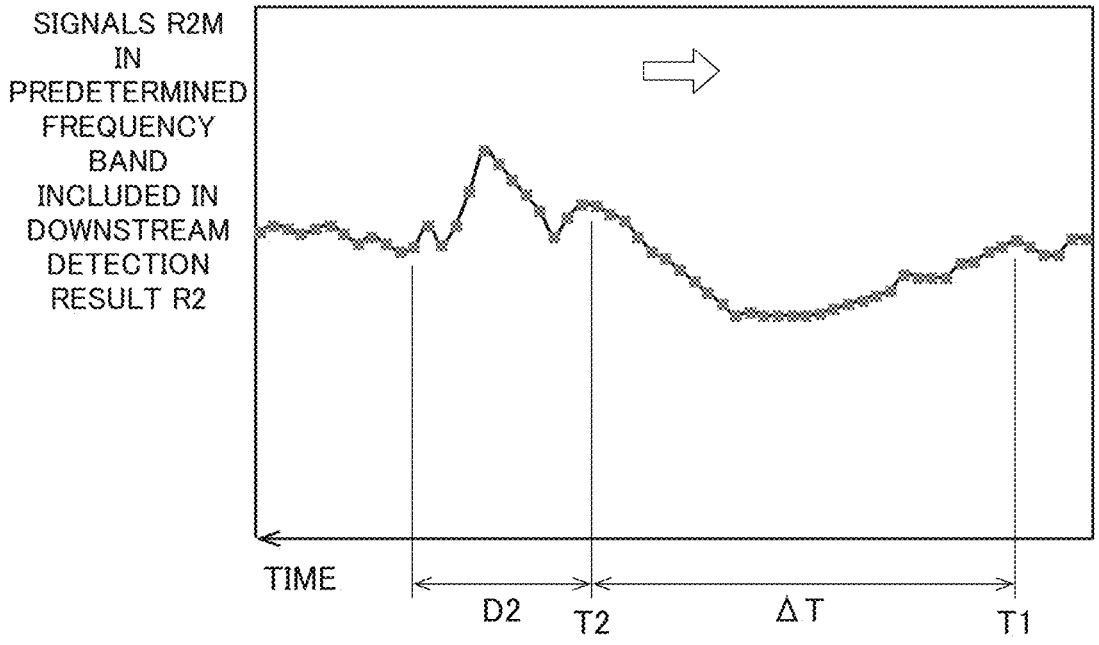
FIG. 7 is a graph showing an example of signals in the predetermined frequency band included in the downstream detection result according to the first embodiment.

Next, the displacement amount calculation part 41 compares the signals R1M in the predetermined frequency band extracted from the upstream detection result R1 and the signals R2M in the predetermined frequency band extracted from the downstream detection result R2. Then, the displacement amount calculation part 41 identifies portions where the same edge 91 of the printing paper 9 has been detected in the upstream detection result R1 and the downstream detection result R2. Specifically, for each data section (a given range of time) that is included in the signals R1M in the predetermined frequency band extracted from the upstream detection result R1, the displacement amount calculation part 41 identifies a highly matched data section from among a plurality of data sections (given ranges of time) included in the signals R2M in the predetermined frequency band extracted from the downstream detection result R2. Hereinafter, each data section included in the signals R1M in the predetermined frequency band extracted from the upstream detection result R1 is referred to as an "upstream data section D1" as illustrated in FIG. 6C. Also, each data section included in the signals R2M in the predetermined frequency band extracted from the downstream detection result R2 is referred to as a "downstream data section D2" as illustrated in FIG. 7.

To identify a highly matched data section, for example, a matching technique such as cross-correlation or a residual sum of squares is used. For each upstream data section D1, the displacement amount calculation part 41 selects a plurality of downstream data sections D2 as candidates for the corresponding data section. Also, for each of the downstream data sections D2 selected as the candidates, the displacement amount calculation part 41 calculates an evaluation value that indicates the degree of matching with the upstream data section D1. Then, a downstream data section D2 with a highest evaluation value is identified as a downstream data section D2 that corresponds to the upstream data section D1 (that is most highly matched with the upstream data section D1). Alternatively, the downstream data section D2 that is most highly matched with the upstream data section D1 may be identified by calculating a difference value between the upstream data section D1 and each of the plurality of downstream data sections D2 and comparing the calculated difference values. As another alternative, the downstream data section D2 that is most highly matched with the upstream data section D1 may be identified by calculating an absolute difference value between each of a plurality of sample points included in the upstream data section D1 and each of a plurality of sample points included in each downstream data section D2 and then calculating an average of sums of these absolute difference values (mean absolute error: MAE).

Here, a method is described for selecting a plurality of downstream data sections D2 as candidates for the data section corresponding to one upstream data section D1. In the following description, the "ideal transport time" is assumed to be a duration of time required to transport the printing paper 9 from the upstream detection position Pa to the downstream detection position Pb in the case where no skids occur between the printing paper 9 and the surface of each roller of the transport mechanism 10 or no elongation of the printing paper 9 is caused by ink ejection. In this case, a time difference between the upstream detection result R1 and the downstream detection result R2 does not considerably differ from the ideal transport time required to transport the printing paper 9 from the upstream detection position Pa to the downstream detection position Pb. Thus, the displacement amount calculation part 41 may estimate a data section that appears around a time after the elapse of the ideal transport time since the upstream data section D1 to be the downstream data section D2 corresponding to the upstream data section D1, and may select a plurality of downstream data sections D2 that is located in close proximity to the estimated downstream data section D2 as candidates for the data section corresponding to the upstream data section D1.

In this way, the displacement amount calculation part 41 may estimate a downstream data section D2 that corresponds to the upstream data section D1 and search only the proximity of the estimated data section for a downstream data section D2 that is highly matched with the upstream data section D1. In this case, the range of search for the downstream data section D2 is narrowed. Accordingly, it is possible to reduce computational processing loads on the displacement amount calculation part 41.

Figure 8:
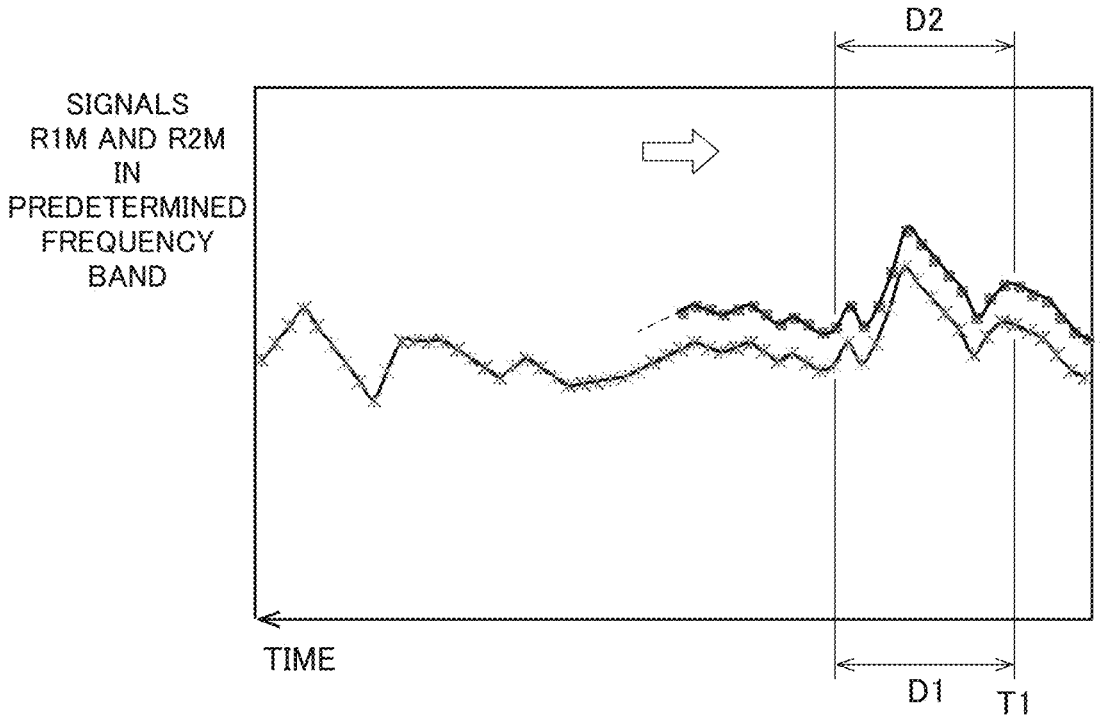
FIG. 8 is a graph obtained by overlaying the example of the signals in the predetermined frequency band included in the upstream detection result and the example of the signals in the predetermined frequency band included in the downstream detection result according to the first embodiment.

Thereafter, on the basis of a time difference between the detection time of the upstream data section D1 (time T1 in FIG. 6C) and the detection time of the downstream data section D2 that is most highly matched with the upstream data section D1 (time T2 in FIG. 7), the displacement amount calculation part 41 calculates an actual transport time ΔT (time difference between time T2 and time T1) required to transport the printing paper 9 from the upstream detection position Pa to the downstream detection position Pb. The displacement amount calculation part 41 also calculates an actual transport speed of the printing paper 9 travelling under the image recording part 20 from the calculated transport time ΔT. The actual transport speed can be calculated by dividing the distance from the upstream detection position Pa to the downstream detection position Pb by the transport time ΔT. FIG. 8 is a graph obtained by overlaying the example of the signals R1M in the predetermined frequency band extracted from the upstream detection result R1 and the example of the signals R2M in the predetermined frequency band extracted from the downstream detection result R2 after the elapse of the transport time ΔT. In FIG. 8, the graph showing the aforementioned example of the signals R2M in the predetermined frequency band is moved in the horizontal direction such that the detection time T2 of the downstream data section D2 corresponding to the upstream data section D1 is overlaid on the detection time T1 of the upstream data section D1, and is then superimposed and displayed on the graph showing the aforementioned example of the signals R1M in the predetermined frequency band.

When the actual transport speed of the printing paper 9 has been calculated, the displacement amount calculation part 41 calculates the times at which each portion of the printing paper 9 actually arrives at the first, second, third, and fourth processing positions P1, P2, P3, and P4, on the basis of the calculated transport speed. Thereby, the displacement amount calculation part 41 calculates the amount of displacement of the printing paper 9 in the transport direction from the position of the printing paper 9 that is transported at the ideal transport speed. Note that the times at which each portion of the printing paper 9 actually arrives at the first, second, third, and fourth processing positions P1, P2, P3, and P4 can be calculated by dividing the distance from the upstream detection position Pa to each of the first, second, third, and fourth processing positions P1, P2, P3, and P4 by the actual transport speed. Also, the amount of displacement of the printing paper 9 in the transport direction can be calculated by multiplying a difference between the actual arrival time of the printing paper 9 at each of a plurality of locations including the first, second, third, and fourth processing positions P1, P2, P3, and P4 and the assumed arrival time thereof when the printing paper 9 is transported at the ideal transport speed, by the actual transport speed.

Note that other methods may be used to calculate the amounts of displacement of the printing paper 9 in the transport direction at the first, second, third, and fourth processing positions P1, P2, P3, and P4. For example, the amount of displacement of the printing paper 9 in the transport direction at the downstream detection position Pb may be calculated by multiplying a difference between the actual arrival time of the printing paper 9 at the downstream detection position Pb and the assumed arrival time thereof when the printing paper 9 is transported at the ideal transport speed, by the actual transport speed. Then, the amounts of displacement of the printing paper 9 in the transport direction at the first, second, third, and fourth processing positions P1, P2, P3, and P4 may be calculated by allocating portions of (or dividing) the amount of displacement of the printing paper 9 in the transport direction at the downstream detection position Pb according to the positional relationship of the processing positions P1 to P4, the upstream detection position Pa, and the downstream detection position Pb. For example, in the case where the six positions in total, including the four processing positions P1 to P4 and the two detection positions Pa and Pb, are aligned at equal intervals, the amount of displacement of the printing paper 9 in the transport direction at the fourth processing position P4, which is closest to the downstream detection position Pb, can be estimated to be a value obtained by multiplying the amount of displacement of the printing paper 9 in the transport direction at the downstream detection position Pb by four fifth.

Moreover, for example in the case where the downstream detection position Pb is located extremely close to the fourth processing position P4, the amount of displacement at the fourth processing position P4 may be regarded as the same as the amount of displacement of the printing paper 9 in the transport direction at the downstream detection position Pb.

In this way, the image recording apparatus 1 according to the present embodiment detects the shape of the edge 91 of the printing paper 9 at the two positions, namely the upstream detection position Pa and the downstream detection position Pb, and calculates the amount of displacement of the printing paper 9 in the transport direction on the basis of detection results. Thus, the amount of displacement of the printing paper 9 in the transport direction can be detected without depending on images such as register marks formed on the surface of the printing paper 9.

In particular, according to the present embodiment, the displacement amount calculation part 41 identifies a highly matched downstream data section D2 for each upstream data section D1 by using the results of comparison between the signals R1M in the predetermined frequency band, which are extracted by removing cyclic noise from the upstream detection result R1 that has a complicated waveform, and the signals R2M in the predetermined frequency band, which are extracted by removing cyclic noise from the downstream detection result R2 that has a complicated waveform. The signals R1M in the predetermined frequency band and the signals R2M in the predetermined frequency band include signals originating from distinctive shapes that mainly appear in each portion of the edge 91. Thus, the displacement amount calculation part 41 can accurately and easily identify a downstream data section D2 that is highly matched with the upstream data section D1, without performing additional computations such as correlation or interpolation. As a result, it is possible to detect the amount of displacement of the printing paper 9 in the transport direction or the amount of difference in the transport speed of the printing paper 9 with high accuracy and in real time and to correct those amounts as will be described later. Accordingly, a high-quality print image with less mutual misregistration of the single-color images can be obtained. Also, the amount of computation performed by the displacement amount calculation part 41 can be reduced, which contributes a cost reduction.

In the present embodiment, the recording heads 21 to 24 of the image recording part 20 that are located between the upstream detection position Pa and the downstream detection position Pb eject ink droplets to the surface of the printing paper 9. Thus, even if the length of the printing paper 9 in the transport direction is locally elongated due to adhesion of ink, the amount of displacement in the transport direction caused by this elongation can be calculated from the detection results obtained at the upstream detection position Pa and the downstream detection position Pb.

Note that, after having identified the downstream data section D2 that corresponds to the upstream data section D1, the displacement amount calculation part 41 may further identify particularly highly matched portions in the corresponding upstream and downstream data sections D1 and D2. For example, the displacement amount calculation part 41 may divide the upstream data section D1 into a plurality of upstream sub-data sections, divide the downstream data section D2 into a plurality of downstream sub-data sections, and sequentially calculate the degree of matching between one of the upstream sub-data sections and one of the downstream sub-data sections. That is, the displacement amount calculation part 41 may sequentially calculate the degree of matching between each upstream sub-data section that is included in and shorter than the upstream data section D1 and each downstream sub-data section that is included in and shorter than the downstream data section D2. Then, the displacement amount calculation part 41 may calculate the actual transport time ΔT required to transport the printing paper 9 from the upstream detection position Pa to the downstream detection position Pb, on the basis of a time difference between the detection time of a most highly matched upstream sub-data section and the detection time of a most highly matched downstream sub-data section. This enables more detailed identification of the portions where the same edge 91 of the printing paper 9 has been detected. Accordingly, the amount of displacement of the printing paper 9 in the transport direction or the amount of difference in the transport speed of the printing paper 9 can be detected with higher accuracy.

After having identified the downstream data section D2 that corresponds to the upstream data section D1, the displacement amount calculation part 41 may further calculate an evaluation value that indicates the degree of matching between the upstream data section D1 and at least one downstream data section D2 (hereinafter, referred to a "different downstream data section D2") that is selected from among the plurality of downstream data sections D2 included in the signals R2M in the predetermined frequency band extracted from the downstream detection result R2, excluding the downstream data section D2 identified as being most highly matched with the upstream data section D1. Then, the displacement amount calculation part 41 may compare the degree of matching between the upstream data section D1 and the downstream data section D2 identified as being most highly matched with the upstream data section D1, with the degree of matching between the upstream data section D1 and the different downstream data section D2. This allows the displacement amount calculation part 41 to recheck whether the portions where the same edge 91 of the printing paper 9 was detected has been properly identified from the upstream detection result R1 and the downstream detection result R2. As a result, the amount of displacement of the printing paper 9 in the transport direction or the amount of difference in the transport speed of the printing paper 9 can be detected with higher accuracy.

The description returns to FIG. 4. The ejection correction part 42 corrects the timing of ejection of ink droplets from each of the recording heads 21 to 24 on the basis of the amount of displacement of the printing paper 9 in the transport direction, calculated by the displacement amount calculation part 41. For example, in the case where the time at which an image recording portion of the printing paper 9 arrives at each of the processing positions P1 to P4 lags behind the ideal time, the ejection correction part 42 delays the timing of ejection of ink droplets from each of the recording heads 21 to 24. Also, in the case where the time at which an image recording portion of the printing paper 9 arrives at each of the processing positions P1 to P4 is earlier than the ideal time, the ejection correction part 42 advances the timing of ejection of ink droplets from each of the recording heads 21 to 24. Note that the amount of correction by which the timing of ejection of ink droplets is corrected may be calculated by, for example, dividing the amount of displacement of the printing paper 9 at each of the processing positions P1 to P4 by the actual transport speed of the printing paper 9.

The print instruction part 43 controls operations of ejecting ink droplets from each of the recording heads 21 to 24 on the basis of received image data I. At this time, the print instruction part 43 references the amount of correction of the ejection timing that is output from the ejection correction part 42. Then, the print instruction part 53 shifts the original timing of ejection based on the image data I in accordance with the amount of correction. This allows ink droplets of each color to be ejected in appropriate locations in the transport direction on the printing paper 9 at each of the processing positions P1 to P4. This suppresses mutual misregistration of the single-color images formed by each color ink. As a result, it is possible to obtain a high-quality print image with less mutual misregistration of the single-color images.

2. Second Embodiment

Next, a configuration of an image recording apparatus according to a second embodiment of the present invention will be described. The image recording apparatus according to the second embodiment includes a transport mechanism, an image recording part, two edge sensors 30B, and a controller. Note that portions other than the two edge sensors 30B of the image recording apparatus according to the second embodiment are identical in structure to the portions other than the two edge sensors 30 of the image recording apparatus 1 according to the first embodiment, and therefore a redundant description thereof is omitted.

Figure 9:
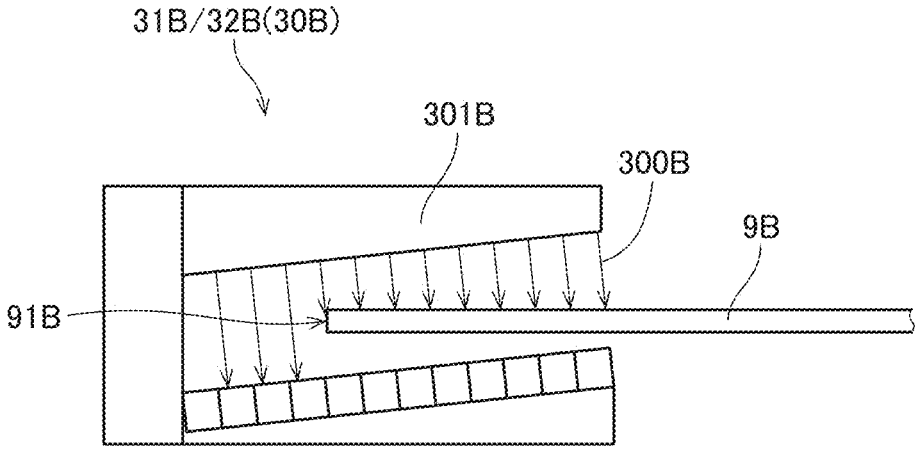
FIG. 9 schematically illustrates a structure of an edge sensor according to a second embodiment.

FIG. 9 schematically illustrates a structure of each edge sensor 30B. As illustrated in FIG. 9, a projector 301B of an upstream edge sensor 31B according to the present embodiment is inclined to the width direction of printing paper 9B at approximately 1 to 10°. The projector 301B of a downstream edge sensor 32B is also inclined to the width direction of the printing paper 9B at approximately 1 to 10°. The upstream edge sensor 31B and the downstream edge sensor 32B each detect the position of an edge 91B of the printing paper 9B in the width direction with use of light projected along an inclined optical axis 300B. It is preferable that the optical axis 300B of the projector 301B of the upstream edge sensor 31B and the optical axis 300B of the projector 301B of the downstream edge sensor 32B are inclined at the same angle to the width direction of the printing paper 9B.

Since the upstream edge sensor 31B and the downstream edge sensor 32B have the inclined optical axes 300B, the light emitted from the projectors 301B impinges on the end face (side face) that forms the edge 91B of the printing paper 9B. That is, the light impinges on a portion that is not irradiated with light if the optical axes 300B have no inclination. This enables more detailed and highly accurate detection of the position of the edge 91B in the width direction. Accordingly, portions where the same edge 91B of the printing paper 9B has been detected can be identified with higher accuracy. Note that the projectors 301B of the upstream edge sensor 31B and the downstream edge sensor 32B may be inclined to the transport direction of the printing paper 9B. That is, it is sufficient for the projector 301B of the upstream edge sensor 31B and the projector 301B of the downstream edge sensor 32B to be inclined to at least one of the transport direction and the width direction. Then, each of the upstream edge sensor 31B and the downstream edge sensor 32B may detect the position, using the light projected along the optical axis 300B that is inclined to at least one of the transport direction and the width direction of the printing paper 9B. It is preferable that the optical axis 300B of the projector 301B of the upstream edge sensor 31B and the optical axis 300B of the projector 301B of the downstream edge sensor 32B are inclined at the same angle to the transport direction of the printing paper 9B.

3. Third Embodiment

Next, a configuration of an image recording apparatus according to a third embodiment of the present invention will be described. The image recording apparatus according to the third embodiment includes a transport mechanism, an image recording part, two edge sensors 30C, and a controller. Note that the portions other than the two edge sensors 30C of the image recording apparatus according to the third embodiment are identical in structure to the portions other than the two edge sensors 30 of the image recording apparatus 1 according to the first embodiment, and therefore a redundant description thereof is omitted.

Figure 10:
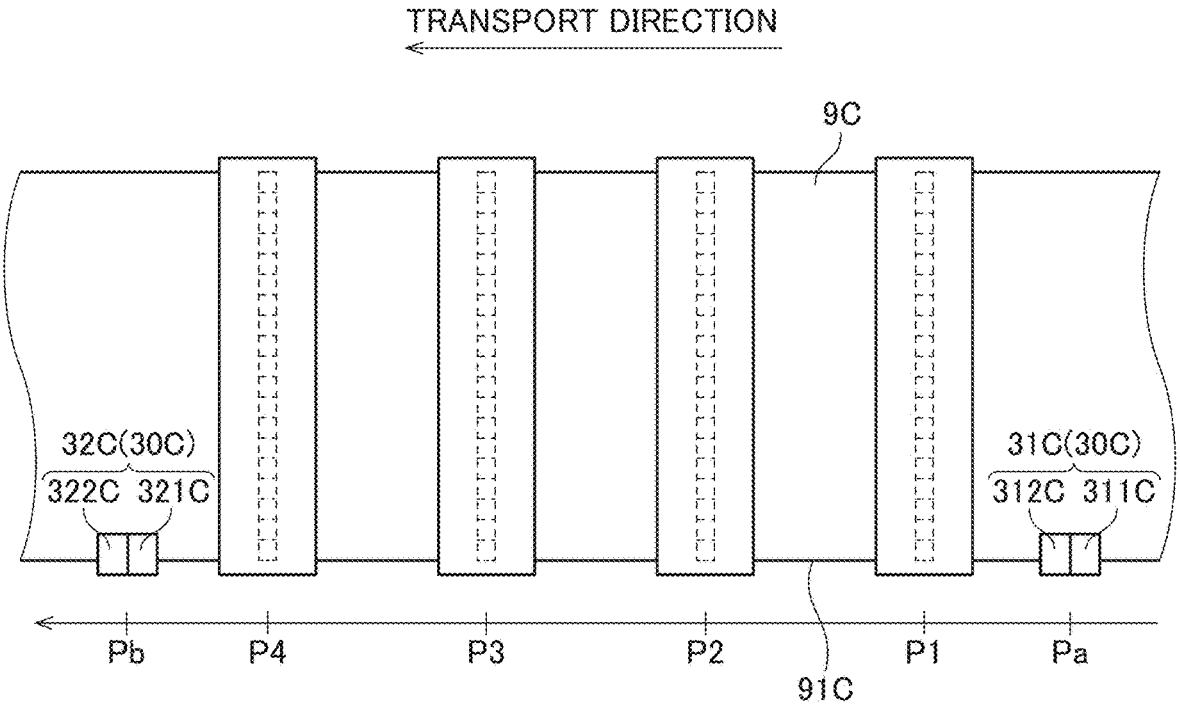
FIG. 10 is a partial top view of an image recording apparatus in the proximity of an image recording part according to a third embodiment.

FIG. 10 is a partial top view of the image recording apparatus in the proximity of the image recording part according to the third embodiment. In the example in FIG. 10, an upstream edge sensor 31C includes a first edge sensor 311C and a second edge sensor 312C. The first edge sensor 311C and the second edge sensor 312C are disposed, either adjoining to each other or slightly spaced from but in close proximity to each other, along the transport direction of printing paper 9C at the upstream detection position Pa. The first edge sensor 311C and the second edge sensor 312C intermittently detect the position of an edge 91C of printing paper 9C in the width direction.

The first edge sensor 311C acquires a first detection result that indicates a time-varying change in the position of the edge 91C in the width direction. The first edge sensor 311C then outputs a detection signal indicating the acquired first detection result to the controller. The second edge sensor 312C acquires a second detection result that indicates a time-varying change in the position of the edge 91C in the width direction. The second edge sensor 312C then outputs a detection signal indicating the acquired second detection result to the controller.

Here, the timing of detection of the edge 91C by the first edge sensor 311C and the timing of detection of the edge 91C by the second edge sensor 312C are different. The controller generates an upstream detection result R1 on the basis of the first detection result and the second detection result that have been detected at different times. For example, the controller generates the upstream detection result R1 by adding the first detection result and the second detection result together. This increases the number of data pieces, included in the upstream detection result R1, about the position of the edge 91C in the width direction of the printing paper 9C that is passing through the upstream detection position Pa. As a result, data that indicates in greater detail a time-varying change in the position of the edge 91C in the width direction of the printing paper 9C that is passing through the upstream detection position Pa can be obtained without changing the specifications of the first edge sensor 311C and the second edge sensor 312C (without changing the number of data pieces that can be acquired per unit time by each sensor). Note that the timing of detection of the edge 91C by the first edge sensor 311C and the timing of detection of the edge 91C by the second edge sensor 312C may be the same. Then, an average value of the first detection result and the second detection result may be calculated. Moreover, a portion of the edge 91C that is detected by the first edge sensor 311C and a portion of the edge 91C that is detected by the second edge sensor 312C may be shifted in the transport direction or the width direction.

The downstream edge sensor 32C includes a third edge sensor 321C and a fourth edge sensor 322C. The third edge sensor 321C and the fourth edge sensor 322C are disposed, either adjoining to each other or slightly spaced from but in close proximity to each other, along the transport direction of printing paper 9C at the downstream detection position Pb. The third edge sensor 321C and the fourth edge sensor 322C intermittently detect the position of the edge 91C of the printing paper 9C in the width direction.

The third edge sensor 321C acquires a third detection result that indicates a time-varying change in the position of the edge 91C in the width direction. The third edge sensor 321C then outputs a detection signal indicating the acquired third detection result to the controller. The fourth edge sensor 322C acquires a fourth detection result that indicates a time-varying change in the position of the edge 91C in the width direction. The fourth edge sensor 322C then outputs a detection signal indicating the acquired fourth detection result to the controller.

Here, the timing of detection of the edge 91C by the third edge sensor 321C and the timing of detection of the edge 91C by the fourth edge sensor 322C are different. The controller generates a downstream detection result R2 on the basis of the third detection result and the fourth detection result that have been detected at different times. For example, the controller generates the downstream detection result R2 by adding the third detection result and the fourth detection result together. This increases the number of data pieces, included in the downstream detection result R2, about the position of the edge 91C in the width direction of the printing paper 9C that is passing through the downstream detection position Pb. As a result, data that indicates in greater detail a time-varying change in the position of the edge 91C in the width direction of the printing paper 9C that is passing through the downstream detection position Pb can be obtained without changing the specifications of the third edge sensor 321C and the fourth edge sensor 322C (without changing the number of data pieces that can be acquired per unit time by each sensor). Note that the timing of detection of the edge 91C by the third edge sensor 321C and the timing of detection of the edge 91C by the fourth edge sensor 322C may be the same. Then, an average value of the third detection result and the fourth detection result may be calculated. Moreover, a portion of the edge 91C that is detected by the third edge sensor 321C and a portion of the edge 91C that is detected by the fourth edge sensor 322C may be shifted in the transport direction or the width direction.

4. Variations

While exemplary embodiments of the present invention have been described thus far, the present invention is not intended to be limited to the embodiments described above.

In the above-described embodiments, the ejection correction part 42 corrects the timing of ejection of ink droplets from each of the recording heads 21 to 24 on the basis of the amount of displacement of the printing paper 9 in the transport direction, calculated by the displacement amount calculation part 41. However, instead of correcting the timing of ejection of ink droplets, the amount of displacement of the printing paper 9 in the transport direction may be corrected by correcting drive of at least one of the plurality of rollers on the basis of the amount of displacement of the printing paper 9 in the transport direction, calculated by the displacement amount calculation part 41. For example, in the case where the time at which an image recording portion of the printing paper 9 arrives at each of the processing positions P1 to P4 lags behind the ideal time, the number of revolutions of the rollers may be adjusted so as to change and increase the transport speed of the printing paper 9. This enables a correction to be made such that ink droplets of each color are ejected in appropriate locations in the transport direction on the printing paper 9.

In the above-described embodiments, the ejection correction part 42 corrects the timing of ejection of ink droplets from the recording heads 21 to 24 without correcting the received image data I itself. However, the ejection correction part 42 may correct the image data I on the basis of the amount of displacement of the printing paper 9 in the transport direction, calculated by the displacement amount calculation part 41. In that case, the print instruction part 43 only needs to instruct each of the recording heads 21 to 24 to eject ink droplets in accordance with the corrected image data I.

In FIG. 2 described above, the nozzles 201 of each of the recording heads 21 to 24 are arranged in a single line in the width direction. However, the nozzles 201 of each of the recording heads 21 to 24 may be arranged in two or more lines.

Figure 11:
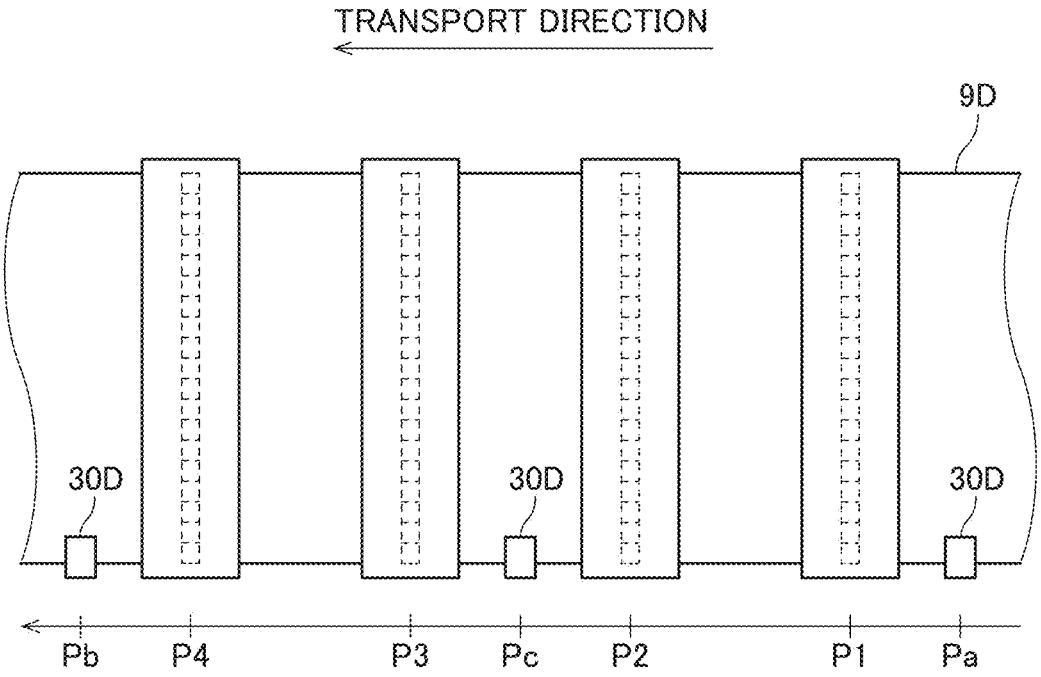
FIG. 11 is a partial top view of an image recording apparatus in the proximity of an image recording part according to a variation.

In the above-described embodiments, the edge sensors 30 are disposed at only the two positions, namely the upstream detection position Pa and the downstream detection position Pb. However, the number of edge sensors 30 disposed in the transport path of the printing paper 9 may be three or more. For example, as illustrated in FIG. 11, edge sensors 30D may be disposed at three positions in the transport path, including the upstream detection position Pa located upstream of the first processing position P1, an intermediate detection position Pc located between the second and third processing positions P2 and P3, and the downstream detection position Pb located downstream of the fourth processing position P4. In this case, the amount of displacement of printing paper 9D in the transport direction can be calculated with higher accuracy on the basis of detection results obtained by the three edge sensors 30D. For example, even if the amount of displacement of the printing paper 9D in the transport direction between the first and second processing positions P1 and P2 and the amount thereof between the third and fourth processing positions P3 and P4 are different due to a difference in the amount of ink adhesion, it is possible to properly detect the amount of displacement at each processing position.

The edge sensors may be provided at positions under the recording heads. For example, the edge sensors may be provided at positions under each of the four recording heads.

In the above-described embodiments, the edge sensors are provided on only one side in the width direction of the printing paper. However, the edge sensors may be provided on both sides in the width direction of the printing paper. In this case, the amount of displacement of the printing paper in the transport direction can be detected on the basis of detection results of the edges on both sides in the width direction of the printing paper. This further improves the accuracy of detecting the amount of displacement.

The image recording apparatuses according to the above-described embodiments calculate the transport speed of the printing paper on the basis of the signals obtained from the edge sensors and calculate the amount of displacement of the printing paper in the transport direction on the basis of the calculated transport speed. However, the image recording apparatuses may correct the timing of ejection of ink droplets from the recording heads or correct the drive of the rollers on the basis of the amount of difference in the transport speed of the printing paper. That is, it is sufficient for the displacement amount calculation part to be configured to calculate either the amount of displacement of the printing paper in the transport direction or the amount of difference in the transport speed of the printing paper.

The image recording apparatuses may have the function of detecting and correcting the amount of displacement of the printing paper in the width direction on the basis of signals obtained from the upstream edge sensor (upstream detector) and the downstream edge sensor (downstream detector). The image recording apparatuses may also have the function of detecting and correcting meandering motion of the printing paper, a change in the obliqueness of the printing paper, the travelling position of the printing paper, or a change in the dimension of the printing paper in the width direction on the basis of the amount of displacement of the printing paper in the width direction. This eliminates the need to separately provide an edge sensor that detects the amount of displacement of the printing paper in the transport direction and an edge sensor that detects the amount of displacement of the printing paper in the width direction. Accordingly, it is possible to reduce the number of parts of the image recording apparatuses.

In the above-described embodiments, transmission edge sensors are used as the upstream and downstream detectors. However, the upstream and downstream detectors may use other detection methods. For example, reflection optical sensors or CCD cameras may be used. The upstream and downstream detectors may be configured to detect the position of the edge of the printing paper two-dimensionally in the transport direction and the width direction. The upstream and downstream detectors may perform the detection operation intermittently as in the above-described embodiments, or may perform the detection operation successively. Moreover, the first and second edge sensors included in the upstream edge sensor (upstream detector) according to the above-described third embodiment may perform the detection operation intermittently, or may perform the detection operation successively. Also, the third and fourth edge sensors included in the downstream edge sensor (downstream detector) according to the above-described third embodiment may perform the detection operation intermittently, or may perform the detection operation successively.

In the above-described embodiments, for example, a clock or counter that is provided separately from the image recording apparatus can be used to measure the transport time of the printing paper or the arrival time at each location. However, instead of using such a clock or counter, the transport time and the arrival time may be measured on the basis of signals received from rotary encoders connected to the rollers, which are rotationally driven at a constant rotation speed by the transport mechanism.

In the above-described embodiments, the image recording apparatuses each include four recording heads. However, the number of recording heads included in the image recording apparatus may be in the range of one to three or may be five or more. For example, another recording head that ejects ink of a special color may be provided, in addition to the recording heads that eject ink of K, C, M, and Y colors. Moreover, these recording heads do not necessarily have to be disposed at equal intervals.

The present invention does not intend to exclude the case of detecting the amount of displacement of the printing paper on the basis of reference images such as register marks formed on the surface of the printing paper. For example, detection results obtained using the reference images such as register marks and detection results of the edge obtained by the edge sensors as described above may be used in combination to detect the amount of displacement of the printing paper in the transport direction or the amount of difference in the transport speed of the printing paper.

The image recording apparatuses described above are configured to record a multicolor image on printing paper by inkjet printing. However, the base material processing apparatus according to the present invention may be configured to use a method other than inkjet printing (e.g., electrophotography or exposure) to record a multicolor image on printing paper. Also, the image recording apparatuses described above are configured to perform print processing on printing paper that is a base material. However, the base material processing apparatuses according to the present invention may be configured to perform predetermined processing on a long band-like base material (e.g., a resin film or metal leaf) other than ordinary paper. That is, processing parts in the base material processing apparatuses according to the present invention may be configured to process the base material at processing positions in the transport path.

Each component described in the embodiment and variations described above may be combined appropriately within a range that causes no contradictions.

While the invention has been shown and described in detail, the foregoing description is in all aspects illustrative and not restrictive. It is therefore to be understood that numerous modifications and variations can be devised without departing from the scope of the invention.

What is claimed is:

1. A base material processing apparatus comprising:

a transport mechanism that transports a long band-like base material in a longitudinal direction along a predetermined transport path;

an upstream detector that successively or intermittently detects a position of an edge of the base material in a width direction at an upstream detection position in the transport path to acquire an upstream detection result, wherein the upstream detection result includes data sections, each of the data sections being referred as an upstream data section;

a downstream detector that successively or intermittently detects the position of the edge of the base material in the width direction at a downstream detection position located downstream of the upstream detection position in the transport path to acquire a downstream detection result, wherein the downstream detection result includes data sections, each of the data sections being referred as a downstream data section; and a displacement amount calculation part that, for each of the upstream data sections, identifies a highly matched downstream data section from among a plurality of downstream data sections, and calculates an amount of displacement of the base material in a transport direction or an amount of difference in a transport speed of the base material on the basis of an identification result, wherein the displacement amount calculation part uses a result of comparison between signals in a predetermined frequency band extracted from the upstream detection result and signals in the predetermined frequency band extracted from the downstream detection result to identify the highly matched downstream data section for each of the upstream data sections.

2. The base material processing apparatus according to claim 1, wherein the signals in the predetermined frequency band include signals in a frequency band that corresponds to a shape of at least part of a composition of the base material.

3. The base material processing apparatus according to claim 2, wherein the base material is paper, and the signals in the predetermined frequency band include signals in a frequency band that corresponds to a length or width of cellulose fibers that are the composition of the base material.

4. The base material processing apparatus according to claim 1, wherein the signals in the predetermined frequency band include signals in a frequency band that corresponds to a shape of the edge of the base material.

5. A base material processing apparatus according to claim 1, wherein the upstream detector and the downstream detector each include a projector, the projector of the upstream detector has an optical axis that is inclined to at least one of the transport direction and the width direction of the base material, and the projector of the downstream detector has an optical axis that is inclined to at least one of the transport direction and the width direction of the base material at the same angle as the optical axis of the projector of the upstream detector.

6. A base material processing apparatus according to claim 1, wherein the upstream detector includes a first detector and a second detector that are disposed either adjoining to or in close proximity to each other in the transport direction and that successively or intermittently detect the position of the edge of the base material in the width direction, the upstream detection result is generated based on a detection result obtained by the first detector and a detection result obtained by the second detector, the downstream detector includes a third detector and a fourth detector that are disposed either adjoining to or in close proximity to each other in the transport direction and that successively or intermittently detect the position of the edge of the base material in the width direction, and the downstream detection result is generated based on a detection result obtained by the third detector and a detection result obtained by the fourth detector.

7. The base material processing apparatus according to claim 6, wherein timing of detection by the first detector and timing of detection by the second detector are different, and timing of detection by the third detector and timing of detection by the fourth detector are different.

8. The base material processing apparatus according to claim 6, wherein timing of detection by the first detector and timing of detection by the second detector are the same, and timing of detection by the third detector and timing of detection by the fourth detector are the same.

9. The base material processing apparatus according to claim 1, wherein the displacement amount calculation part estimates a data section of the downstream detection result that corresponds to a data section included in the upstream detection result, and identifies a data section of the downstream detection result that is highly matched with the data section included in the upstream detection result from among data sections that are located in close proximity to the estimated data section.

10. The base material processing apparatus according to claim 1, wherein the displacement amount calculation part calculates a degree of matching between an upstream sub-data section that is included in and shorter than the upstream data section and a downstream sub-data section that is included in and shorter than the downstream data section.

11. The base material processing apparatus according to claim 1, wherein the displacement amount calculation part further compares a degree of matching between the upstream data section and the downstream data section that has been identified as being highly matched with the upstream data section, with a degree of matching between the upstream data section and at least one of the plurality of downstream data sections, excluding the downstream data section that has been identified.

12. The base material processing apparatus according to claim 1, wherein the base material processing apparatus further has a function of detecting an amount of displacement of the base material in the width direction on the basis of signals obtained from the upstream detector and the downstream detector.

13. The base material processing apparatus according to claim 1, further comprising:

a processing part that processes the base material at a processing position in the transport path, wherein the processing part is an image recording part that records an image by ejecting ink to a surface of the base material.

14. The base material processing apparatus according to claim 13, wherein the processing part ejects ink to the surface of the base material at a position located between the upstream detection position and the downstream detection position.

15. The base material processing apparatus according to claim 13, wherein the image recording part includes a plurality of recording heads arranged in the transport direction, and the plurality of recording heads ejects ink of different colors.

16. The base material processing apparatus according to claim 1, wherein the upstream data sections are data sections included in the signals in the predetermined frequency band extracted from the upstream detection result, the downstream data sections are data sections included in the signals in the predetermined frequency band extracted from the downstream detection result, and the displacement amount calculation part uses a result of comparison each of the upstream data sections with the downstream data sections to identify the highly matched downstream data section for each of the upstream data sections.

* * * * *